United States Patent [19]

Oppenheimer

[11] 4,211,418

[45] Jul. 8, 1980

[54] UNATTACHED SWING TEACHING APPARATUS

[76] Inventor: Jess Oppenheimer, 549 Moreno Ave., Los Angeles, Calif. 90049

[21] Appl. No.: 10,554

[22] Filed: Feb. 9, 1979

[51] Int. Cl.[2] ..... A63B 69/36

[52] U.S. Cl. ..... 273/186 R; 273/191 R; 273/190 R; 273/195 R

[58] Field of Search ..... 273/191 R, 191 A, 191 B, 273/186 C, 186 R, 26 R, 29 A, 192, 195 R; 35/29 A, 29 R

[56] References Cited

U.S. PATENT DOCUMENTS

| | | | |
|---|---|---|---|
| 2,737,432 | 3/1956 | Jenks | 273/191 R |
| 3,339,927 | 9/1967 | Nunn | 273/191 A |
| 3,876,212 | 4/1975 | Oppenheimer | 273/191 R X |
| 3,926,430 | 12/1975 | Good | 273/191 R X |

*Primary Examiner*—George J. Marlo
*Attorney, Agent, or Firm*—Nilsson, Robbins, Dalgarn, Berliner, Carson & Wurst

[57] ABSTRACT

An unattached swing teaching apparatus for guiding a golf club or other rod-like object in a predefined arcuate path. A rotating device is rotatably attached to and supported by a non-rotating support member. The rotating device has at least one axle to which a pair of guide rods are attached. Dual axles may be incorporated in conjunction with gearing, clutching and control apparatus to cause rotation to occur about either or both axles as the club is swung through selected portions of the predefined arcuate path. In an initial position, one guide rod extends downward in a position for being contacted by the club shaft. As the backswing commences, the club shaft pushes against the downwardly extending guide rod causing one or more of the axles to rotate during the selected portions of the arcuate swing path. The club will remain in the predefined arcuate path if the golfer keeps the club shaft bearing on the guide rod in a manner which rotates the axle or axles. In a second embodiment, the guide rod may be a single L-shaped member. The vertical and horizontal leg portions of the L-shaped member are sequentially engaged by an extension member attached to the golf club shaft. The horizontal leg portion passes under a platform on which the golfer stands. In either embodiment, the golfer's head may be restrained by a head engaging device, and resistance to the rotating guide rods may be provided.

14 Claims, 15 Drawing Figures

FIG. 1
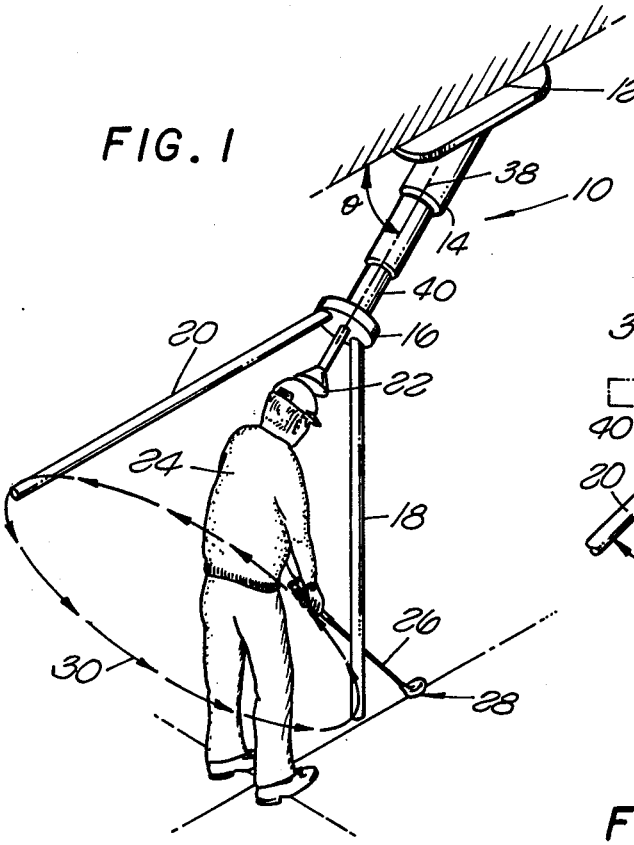
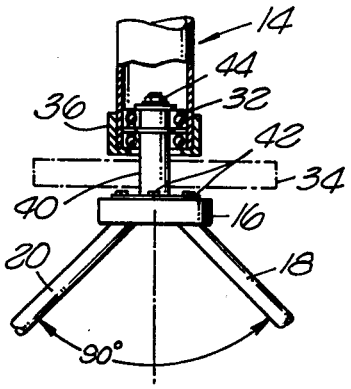
FIG. 3
FIG. 2
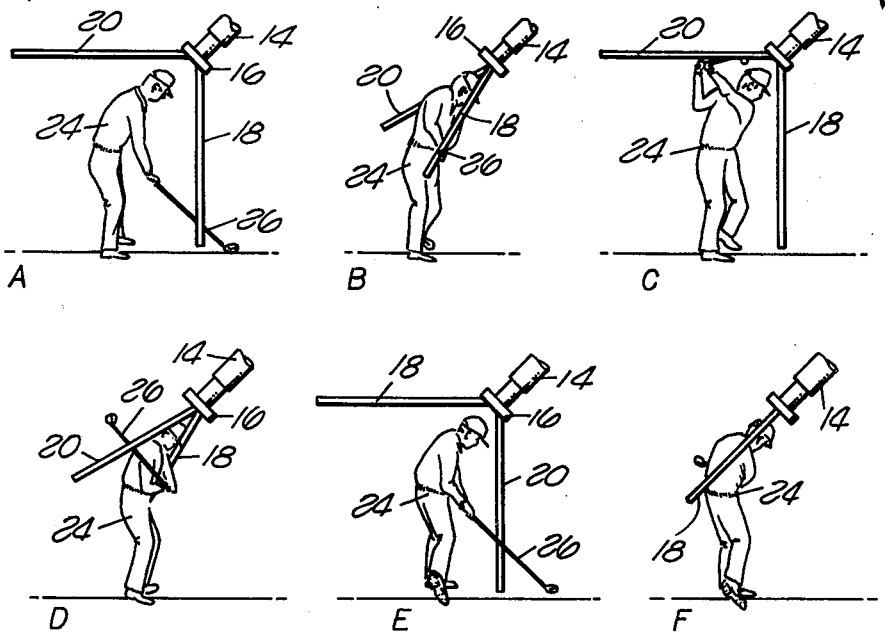

FIG. 4
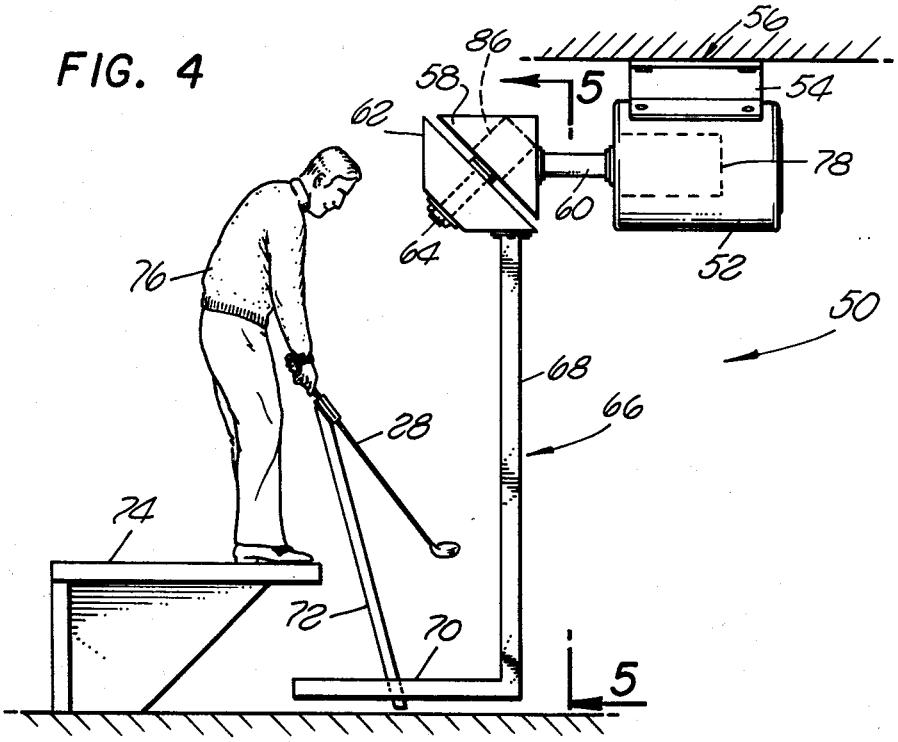
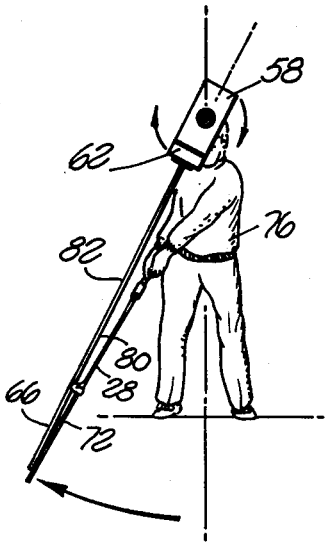
FIG. 5A
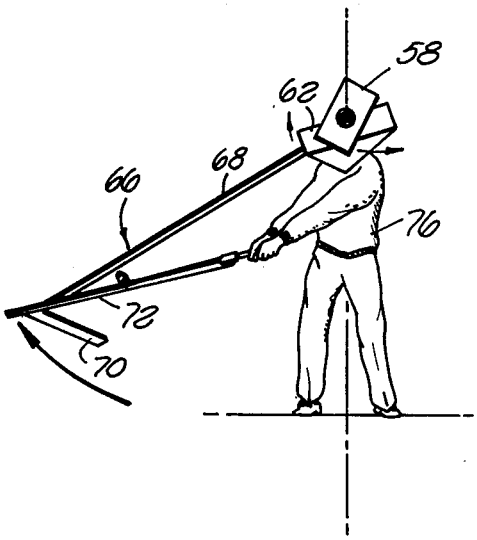
FIG. 5B

UNATTACHED SWING TEACHING APPARATUS

BACKGROUND OF THE INVENTION

The present invention relates to swing teaching apparatus and, in particular, to a swing teaching apparatus which is unattached to the object to be swung and is specifically adapted to enable the user to develop accurate timing and swing positioning as well as increasing his swinging power.

The present invention may be utilized for teaching the user how to swing any rod-like object through an arcuate path. However, for purposes of illustration, the present invention is described in a configuration useful in teaching a golfer how to swing a golf club through a preferred arcuate swing path for a golf club.

In the swinging of any rod-like object, such as a golf club or baseball bat, it is essential that the object be swung through a proper arcuate path in order that maximum power and timing be achieved so that a ball or the like will be propelled with both power and accuracy. Numerous devices have been developed to guide the rod-like object through the proper arcuate path to enable the user to acquire the "feel" of a proper swing so that, with practice, a desired swing will be achieved without requiring the use of the swing teaching apparatus. Patents disclosing examples of such swing teaching apparatus include:

| U.S. Patent No. | Inventor | Date |
|---|---|---|
| 2,448,905 | Milner | 9/7/48 |
| 2,665,378 | Sheffer | 10/13/53 |
| 3,400,933 | Heiser | 9/10/68 |
| 4,047,605 | Rosenvold | 9/13/77 |

However, in each of the above patents, the device is in one way or another attached to the golf club thereby limiting the ability of the inventor to be able to "feel" a proper swing but still, himself, control the direction of the swing of the object. By contrast, the present invention provides a swing teaching apparatus which is not attached to the golf club or other rod-like object, but rather allows the user to "feel" the proper swing direction and thus be able to guide the club through the predefined arcuate path. The guiding is achieved by making it easier to rotate the swing teaching device when the rod-like object is swung through the predefined arcuate path. Because the user learns the proper swing by feeling it, rather than being constrained to it, it is believed that the transition to not using the teaching device, but still maintaining a proper swing, will be more quickly and easily made.

One particular invention which also incorporates an unattached swing teaching apparatus is U.S. Pat. No. 3,698,721, granted to A. A. Stewart on Oct. 17, 1972. In FIGS. 10 through 13 of that invention, an unattached golf swing guide member in the form of spaced apart flexible guides are disclosed. The spaced apart flexible guides are disposed in pairs and adjusted to define an open path through which the golf club is to be swung. If the swing is outside of the path defined by the various pairs of spaced apart flexible guides, the flexible members will sound a warning thus allowing the user to correct the swing path. However, in that invention, the spaced apart flexible guides are not intended to come in contact with the golf club unless the swing is improper. No continuous guidance is contemplated or suggested.

SUMMARY OF THE INVENTION

The present invention comprises an unattached swing teaching apparatus rotatable in response to the swinging of a generally rod-like object, such as a golf club or baseball bat. The swing teaching apparatus is adapted for guiding the object through a predefined arcuate path and comprises a rotating means rotatably attached to and supported by a support means and a guide rod means fixed for rotating with the rotating means. The guide rod means is provided to extend from the rotating means and is positioned for being intermittently contacted and rotated by either the object being swung or the player or any number attached to, and moved by, either the object being swung or the player, for guiding the object through the predefined arcuate path as the object is swung.

In one embodiment of the present invention, the guide rod means comprises a first and second guide rod and a rotating means comprising an axle or shaft rotatably attached to the support means whereby the shaft or axle is rotatable about its longitudinal axis. A means for providing resistance to the rotation of the rotating means as the object is swung may be provided as a means of increasing the power or strength of the user in swinging the object. Such means for providing resistance may include weights attached to the rotating means or may comprise clamping means to increase the resistance between the support means and the rotating means.

The object to be swung preferably has a flat surface which is provided by an alignment means, coupled to or disposed on one side of the object to be swung, and the guide rod means preferably has oppositely disposed flat surfaces. The flat surfaces of the guide rod, the flat surface coupled to the object to be swung and a selected hitting surface on the object are then aligned so that the object will assume a selected orientation when the flat surface coupled to the object is in contact, and parallel to, one of the flat surfaces of one of the guide rods as the object travels along a selected portion of the predefined arcuate path.

The present invention may also incorporate head positioning means adapted to engage and maintain the user's head in a preselected position as the object is swung.

The rotating means may comprise a first shaft means coupled to the support means for being rotated about the longitudinal axis of the first shaft means, and a second shaft means coupled to the first shaft means for being rotated about the longitudinal axis of the second shaft means. The second shaft means and the first shaft means are then positioned so that the axis of the second shaft means intersects the longitudinal axis of the first shaft means.

The rotating means of the swing teaching apparatus may further comprise a counter-rotation means whereby the first shaft means rotates from an initial angular position through a first angle to a second angular position. The counter-rotation means is then engaged for reversing the direction of rotation of the first shaft means and commencing rotation of the second shaft means. Subsequent to reaching the second angular position, the first shaft commences rotation in the opposite direction until it reaches its initial angular position. The second shaft will then have rotated through a second angle relative to the first shaft so that the guide rods assume a third position. On a down swing, the counter-rotation means operates in the reverse manner.

BRIEF DESCRIPTION OF THE DRAWINGS

The invention will be better understood from the detailed description below taken in conjunction with the drawings wherein like reference characters refer to like parts throughout and in which:

FIG. 1 is a perspective view of one embodiment of the present invention incorporating a single shaft or axle;

FIGS. 2A–2F is a sequence illustrative of the operation of the unattached swing teaching apparatus of FIG. 1;

FIG. 3 is a partial cut-away plan view of the unattached swing apparatus of FIG. 1 showing the bearing by which the shaft or axle is attached to the support means;

FIG. 4 is a side plan view of a second embodiment of the present invention; and FIGS. 5A–5F is a sequence illustrative of the various operation positions of the unattached swing teaching apparatus of FIG. 4.

DETAILED DESCRIPTION

Figure 5C:
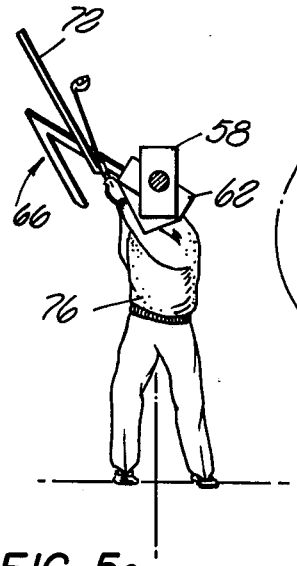

One embodiment of the unattached swing teaching apparatus of the present invention 10 is illustrated in FIG. 1 and comprises a support member 14 fixed to a solid surface 12, such as a wall or a ceiling. A shaft 40 is rotatably coupled to the stationary support member 14 to rotate about a longitudinal axis 38 which is preferably the central axis of the support member 14. Guide rod means, comprising a first guide rod 18 and a second guide rod 20, are fixedly attached to a plate member 16 fixed to the end of the shaft 40 to rotate therewith. The guide rods 18 and 20 may be positioned at any selected projected angle relative to each other in the plane perpendicular to the axis of rotation, i.e. the axis 38.

A head positioning means 22 may optionally be attached to the plate 16 or may extend through the center of the plate 16 and be attached to the support member 14 and fixed thereto. The head positioning means 22 may be attached either to the plate 16 or to the cylindrical member 14 in such a way that the portion of the head positioning means 22 which engages the head of a user 24 will be stationary relative to the rotating means comprising the shaft 40, the plate 16 and the guide rods 18 and 20. Alternatively, the head positioning means may be placed on the ground behind the user to extend up over the user's head without interferring with the rods.

The supporting wall or ceiling 12 is illustrated as generally parallel to the surface upon which the user 24 stands. The support member 14 is then attached to extend downward at an angle $\theta$ which is preferably 45°. The first guide rod 18 and the second guide rod 20 are then fixed to the plate 16 at opposing 45° angles. If, as is preferred, the guide rod 18 and the guide rod 20 are substantially equal length, as the guide rods rotate, their ends will follow a circular path 30 in a plane which is at a 45° angle relative to the ground and which is perpendicular to the longitudinal axis 38.

Referring to FIG. 3, a cross sectional detail of one illustrative means by which the shaft 40 is rotatably attached to the support member 14 is shown. More specifically, the plate 16 is attached to the end of the rotatable shaft 40 by, for example, a plurality of bolts 42. A bearing apparatus 32 is then positioned in the interior of the support member 14, which is illustrated to be a hollow cylinder, and is held in place by an end cap 36. A nut 44 is then placed on the end of the shaft 40 to hold the bearing 32 to the opposite end of the shaft 40.

In an alternative embodiment of the present invention, a means for providing resistance to the swinging of the unattached swing teaching apparatus 10 is illustrated for use in developing the strength of the user or to facilitate slow motion analysis of a user's swing for teaching purposes. For example, the means for providing resistance may be a cylindrical plate 34 which acts as a load to provide resistance to the rotation of the shaft 40. Alternatively, the nut 44 may be tightened or loosened to provide more or less bearing friction and thereby provide more or less resistance to rotation of the shaft 40.

The operation of the unattached swing teaching apparatus may be described with reference to FIGS. 2A through 2F which illustrates various positions of the swing teaching apparatus at corresponding positions of the swing of a golfer. While the present invention is particularly applicable to teaching of a golf swing, it will be appreciated that the present invention may be utilized to guide any rod-like object such as a baseball bat, which is to be swung by a user.

Returning to FIG. 2, the golfer 24 commences his back swing by pushing against the guide rod 18 with the shaft 26, thereby causing the guide rod 18, the guide rod 20, the plate 16 and the shaft 40 to commence rotational motion. At address, the club shaft 26 bears against the rod 18 at a point which is near the end of the rod and also near the clubhead end of the golf club 28. As the back swing continues, the point of contact between the shaft of the club 26 and the rod 18 gradually changes until at the top of the back swing, the bearing point between the rod 18 and the club shaft 26 is near the grip end of the club and near the end of the rod nearest to the plate 16. Thus, even though the apparatus and the club shaft are each continually moving and changing directions and angles, if the golfer maintains the club shaft pushing on the rod 18 in a manner which rotates the plate 16, then the clubhead of the golf club 28 will remain in the plane defined by the rod 18 and the club shaft 26 which is the proper club head orientation.

More specifically, in FIG. 2A, the guide rod 18 is initially placed on the right side of the shaft 26 so that a back swing will set the apparatus into a counter-clockwise rotation as viewed by the golfer 24. The initial push by the shaft 26 is directed to the right to obtain maximum rotation of the apparatus. The golfer continues pushing in a rightward direction as the rod 18 rotates by allowing the club shaft to slide along the rod 18. As the back swing progresses, however, the rod 18 will have moved sufficiently far inside that the golfer will be required to move the club shaft 26 to the insides toward the player to keep the club shaft bearing on the rod. Thus, the rotation of the rod 18 provides a guide for the club shaft along a predefined arcuate path.

In FIG. 2B, the plate 16 is shown rotated approximately 90° so that the golfer will be pushing upwards, with the shaft 26 at an angle of about 45° toward the golfer. In the meantime, the guide rod 20, which was oriented horizontally over the golfer's head at address (FIG. 2A), will have moved down and to the left of the golfer.

In FIG. 2C, the position of the golfer and the unattached swing teaching apparatus is shown at the top of the back swing immediately prior to the commencing of the down swing. In order to arrive at this position, the guide rod 18 was rotated by the shaft 26 until the shaft was above the guide rod 18. At the top of the back swing, the swing stops in preparation for the down swing. However, since the guide rod 18 is below the shaft of the golf club, it continues rotating downwardly from the shaft 26 and to the left of the golfer. The rod 20 also continues to rotate while the golfer maintains a static position at the top of the back swing until the guide rod 20 comes in contact with the top of the shaft 26. Thus, the only time that the shaft 26 is not in contact with either the first guide rod 18 or the second guide rod 20 is when the shaft is stationary at the top of the back swing and the golfer is waiting for the rod 20 to come in contact with the shaft and signal the commencement of the down swing. The golfer is, therefore, forced to await and remain stationary at the top of the back swing. This is desirable in order to teach proper timing in swinging a golf club.

As shown in FIGS. 2D through 2F, the initial push of the down swing is directly to the golfer's right. The shaft of the club continues pushing rightward and increasingly downward until the guide rod 20 is approximately vertical, at which time the golf club contacts the golf ball. By maintaining the shaft of the golf club in contact with the guide rod 20 for a period of time after the vertical position is reached, a proper follow through can also be achieved.

Referring now to FIG. 4, a second embodiment of the present invention is shown having a housing 52 attached by a support flange 54 to a generally horizontal wall or other solid surface 56. Extending from the end of the housing 52 in a substantially horizontal relationship to the support surface 56 is a first shaft 60 to which is fixed a first rotating member 58. In operation, the first rotating member 58 and the first shaft 60 are rotatable relative to the housing 52 and the support surface 56. A second rotating member 62 is rotatably interconnected to the first rotating member 58 by a second shaft 64. Thus, the second rotating member 62 is attached to the second shaft 64 so that both the rotating member 62 and the second shaft 64 rotate together relative to the first rotating member 58.

Attached to the rotating member 62 and extending vertically therefrom is a guide rod means 66 having a vertical leg 68 fixed to the second rotating member 62 and a horizontal leg 70 attached to the end of the vertical leg 68 remote from the second rotating member 62.

In accordance with the second embodiment of the present invention, the golfer 76 or other user stands on a platform 74 and grasps the golf club 28. Attached to the shaft of the golf club and extending downward therefrom is a club extension member 72 which is adapted to sequentially engage the horizontal leg 70 and then the vertical leg 68 of the guide rod means 66 as the club 28 is swung. Of course, it will be appreciated that the club shaft itself, a portion of the user's body or an extension member attached to the user's body may be used to engage the guide rod. In the preferred embodiment, the guide rod 66 has two flat surfaces 80 and 82, as illustrated in FIG. 5A. In addition, the club extension member is adapted to be positioned against the flat surface 80 of the guide rod 66 during the initial portion of the back swing and against the flat surface 82 of the guide rod 66 during the portion of the downswing at which the club 28 passes through the hitting region, i.e., when the horizontal leg 70 of the guide rod 66 is substantially horizontal or parallel to the ground.

As shown in FIG. 4, the end of the horizontal leg 70 of the guide rod means 66 extends to pass beneath the feet of the golfer 76 as he is standing on the platform 74. The ball (not shown) could be supported on a high balanced tee which would be knocked over by the horizontal leg 70 after the ball is hit. In operation the flat surface of the club extension 72, the face of the club 28 and the flat surfaces of the guide rod 66 are aligned so that the face of the club 28 will be in the proper position at the time of ball contact, if the flat surface of the extension portion 72 is held against, and parallel to, the flat surface of the horizontal leg 70.

A counter-rotation means is provided for enabling and preventing rotation of the shafts 60 and 64. The counter-rotation means may, for example, comprise a first rotation assist motor 78 in the housing 52 and a second rotation assist motor 86 in the first rotating member 58, and appropriate associated clutching, gearing and control mechanisms well known in the art.

Referring now to FIGS. 5A through 5F, at address, the flat surface of the club extension 72 is positioned against and parallel to the flat surface 80 along the horizontal leg 70 of the guide rod means 66. As the back swing commences, the rotation assist motors 78 and 86 commence to assist the guide rod means 66 to swing a predefined path in response to the swinging of the club 28. Thus, in FIG. 5A, the golfer commences from an initial address position and moves through an arc of approximately 20° to 30° to a second position. As the golfer swings the club 28 from the initial position to the second position, the first rotating member 58, the second rotating member 62 and the guide rod 66 rotate together about the first shaft 60. The movement of the guide rod from the initial position to the second position is caused primarily by the club extension 72 as it bears against the horizontal leg 70 of the guide rod means 66.

The proper positioning of the club face will be maintained if the golfer keeps the flat surface of the club extension 72 bearing against the flat surface 80 of the horizontal leg 70. The motor 78 may be incorporated for assisting the guide rod apparatus 66 to rotate about the first shaft 60 in response to the swinging of the club 68. The amount of assistance by the motor may be varied to increase or decrease the load or rotational resistance and thereby provide a means of increasing the power of the golfer's swing.

Referring to FIG. 5B, when the guide rod apparatus 66 reaches the second position, the gearing, clutching and control apparatus operate to cause the first rotating member 58 to reverse its rotational direction to rotate in a clockwise direction as viewed by the golfer. At the same time, the second rotating member 62 commences rotation in the counter-clockwise direction relative to the first rotating member 58 as viewed by the golfer 76. The first rotating member 58 continues its clockwise counter-rotation as the second rotating member 62 continues its counter-clockwise rotation until the guide rod apparatus reaches a third position. In the third position, the first rotating member 58 will have rotated clockwise back to its original position when the guide rod apparatus 66 was in its initial position. During the remainder of the back swing from the third position to a fourth position, i.e., the top of the back swing just before commencing the down swing, the rotation of the guide rod means 66 will be about the second shaft 64 with the first rotating member 58 remaining stationary.

Figure 5D:
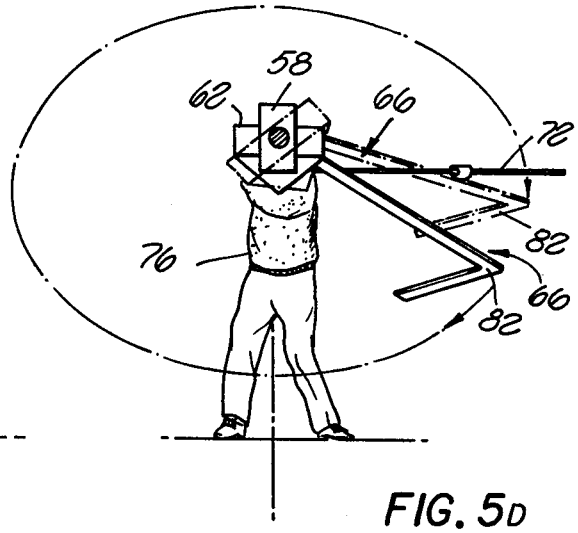

It will be appreciated that, as the back swing progresses from its initial position to its fourth position, the contact point of the club extension 72 on the guide rod means 66 moves along the horizontal leg 70 towards the vertical leg 68 and continues to move up the vertical leg 68 as illustrated in FIG. 5C. When the fourth position, i.e., the top of the back swing, is reached, the guide rod means 66 will be in a position underneath the club extension 72 as seen in FIGS. 5C and 5D. Thus, the guide rod means 66 will not be prevented from continuing to rotate even though the swing of the club will have stopped. The golfer 76 maintains his static, cocked position at the top of the back swing while the guide rod assembly 66 continues to rotate about the second shaft 64. Only when the guide rod assembly 66 has rotated through a full circle so that the opposite side 82 of the guide rod apparatus 66 contacts the club extension 72 does the golfer commence his down swing. It will be appreciated that the duration of time that the golfer maintains his static, cocked position at the top of the backswing may be varied by placing another L-shaped guide rod at a different location on the second rotating member so that the second L-shaped guide rod contacts the shaft sooner. Of course, both guide rods would preferrably be free of the tee at address.

The down swing is essentially the reverse of the back swing. More specifically, as the guide rod apparatus moves from the fourth position back to the third position on the down swing, the rotation will be about the second shaft 64 with the first shaft 60 and the first rotating member 58 remaining stationary. When the third position is reached, the second rotating member 62 continues to rotate in a clockwise direction about the second shaft 64 as viewed by the golfer 76. At the same time, however, the first rotating member 58 commences rotation about the shaft 60 in the counter-clockwise direction (as viewed by the golfer) until the guide rod apparatus reaches the second position. Upon reaching the second position, the rotation of the second rotating member 62 about the second shaft 64 ceases and the direction of rotation of the first rotating member 58 about the first shaft 60 reverses. The guide rod means 66 then rotates about the first shaft 60 down through the first position at which point contact with the ball is made.

Figure 5E:
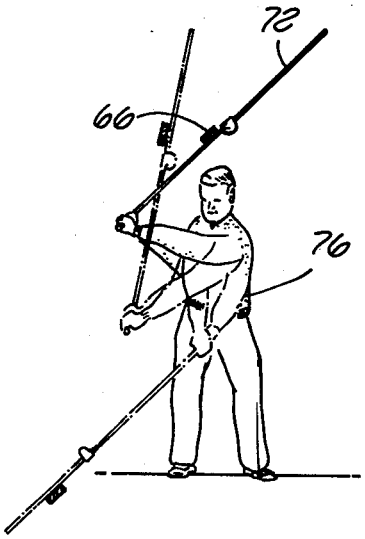
Figure 5F:
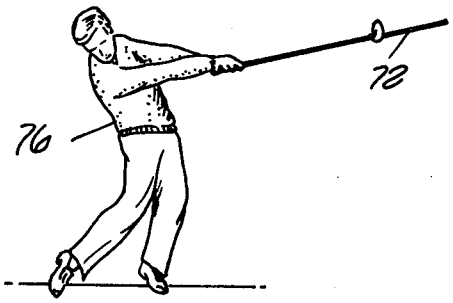

As previously indicated, if the flat surface of the club extension 72 is maintained against the flat surface 82 of the guide rod assembly 66 when contact with the ball is to occur, then the face of the club will be in the proper alignment. FIGS. 5E and 5F show the above sequence as the golfer makes his down swing. After hitting the ball, the club extension 72 may be maintained in contact with the guide rod apparatus 66 with the first rotating member 58 and the second rotating member 62 rotating in an appropriate predefined manner about the first shaft 60 and the second shaft 64 in response to appropriate gearing, clutching and control mechanisms in a manner similar to that previously described. For example, for a running shot the club extension preferrably continues to turn (wrists roll over) while for a shot that bites; the contact of the flat surface of the club extension 72 and the flat surface 82 is maintained as long as possible.

Variations in the arrangement and number of guide rods utilized, as well as the particular type of counter-rotation means, are possible without departing from the spirit of the present invention.

It will be appreciated that the various specific details of the present invention disclosed in conjunction with the description of the embodiments of the present invention have been given by way of illustration only and are not to be taken as or construed in a limiting sense.

What is claimed is:

1. An unattached swing teaching apparatus rotatable in response to the swinging of a generally rod-like object, the swing teaching apparatus being adapted for guiding the object through a predefined arcuate path, the swing teaching apparatus comprising:

support means;

rotating means rotatably attached to and supported by the support means; and guide rod means fixed for rotating with the rotating means, the guide rod means positioned for being intermittently contacted and rotated as the object is swung for guiding the object through the predefined arcuate path.

2. The swing teaching apparatus of claim 1 wherein the guide rod means comprises:

a first guide rod; and a second guide rod, the first and second guide rods being attached to the rotating means.

3. The swing teaching apparatus of claims 1 or 2 wherein the rotating means comprises an axle rotatably attached to the support means, the axle being rotatable about the longitudinal axis.

4. The swing teaching apparatus of claim 1 further comprising means for providing resistance to the rotation of the rotating means as the object is swung.

5. The swing teaching apparatus of claim 1 further comprising alignment means having a flat surface, the alignment means coupled to the object to be swung, wherein the guide rod means comprises at least one guide rod, each guide rod having opposing longitudinally disposed flat surfaces, and the flat surfaces of the guide rod, the flat surface of the alignment means and a selected hitting region on the object are aligned so that the object assumes a selected orientation when the flat surface of the alignment means is in contact with, and parallel to, one of the flat surfaces of one of the guide rod means as the object travels along a selected portion of the predefined arcuate path.

6. The swing teaching apparatus of claim 1 further comprising head positioning means coupled to the support means and adapted for positioning the user's head as the object is swung.

7. The swing teaching apparatus of claim 1 further comprising platform means for supporting a user as the user swings the object, wherein the guide rod means comprises at least one guide rod, each guide rod being substantially L-shaped having a vertical leg and a horizontal leg, wherein the top end of the vertical leg is attached to the rotating means, and the horizontal leg is positioned to rotate beneath the platform means.

8. An unattached swing teaching apparatus rotatable in response to the swinging of a generally rod-like object, the swing teaching apparatus being adapted for guiding the object through a predefined arcuate path, the swing teaching apparatus comprising:

support means;

rotating means comprising:

first axle means coupled to the support means for being rotatable about the longitudinal axis of the first axle means, and second axle means coupled to the first axle means for being rotatable about the longitudinal axis of the second axle means;

guide rod means for rotating with the second axle means, the first axle means, the second axle means and the guide rod means interconnected for being intermittently contacted and rotated in response to rotation of the object, for guiding the object through the predefined arucate path; and means for enabling the first axle means and the second axle means to rotate in selected directions during selected portions of the swing for defining the predefined arcuate path through which the object is to be swung.

9. The swing teaching apparatus of claim 8 further comprising alignment means having a flat surface, the alignment means coupled to the object to be swung, wherein the guide rod means comprises at least one guide rod, each guide rod having opposing longitudinally disposed flat surfaces, wherein the flat surfaces of the guide rod, the flat surface of the alignment means and a selected hitting region on the object are aligned so that the object assumes a selected orientation when the flat surface of the alignment means is in contact with and parallel to one of the flat surfaces of one of the guide rods as the object travels along a selected portion of the predefined arcuate path.

10. The swing teaching apparatus of claim 8 or claim 9 wherein the rotating means further comprises counter-rotation means whereby the first axle means rotates from an original position as the guide rod means rotates from an initial angular position through a first angle to a second angular position, the counter-rotation means being engaged for reversing the direction of rotation of the first axle means and commencing rotation of the second axle means when the second angular position of the guide rod means is reached, the first axle rotating to its original position when the second axle has rotated through a second angle relative to the first axle and the guide rod means has reached a third position, the counter-rotation means being reversibly operable when the object is swung in the opposite direction, the guide rod means commencing opposite rotation from a fourth angular position and continuing in order through the third, second and first angular positions, respectively.

11. The swing teaching apparatus of claim 10 further comprising head positioning means coupled to the support means and adapted for positioning the user's head as the user swings the object.

12. The swing teaching apparatus of claim 10 further comprising platform means for supporting a user as the user swings the object, wherein the guide rod means comprises at least one guide rod, each guide rod being substantially L-shaped having a vertical leg and a horizontal leg, wherein the end of the vertical leg, remote from the horizontal leg, is attached to the rotating means, and the horizontal leg is positioned to rotate beneath the platform means.

13. The swing teaching apparatus of claim 8 or claim 9 further comprising platform means for supporting a user as the user swings the object, wherein the guide rod means comprises at least one guide rod, each guide rod being substantially L-shaped having a vertical leg and a horizontal leg, wherein the end of the vertical leg remote from the horizontal leg is attached to the rotating means and the horizontal leg is positioned to rotate beneath the platform means.

14. The swing teaching apparatus of claim 8 or claim 9 further comprising means for providing resistance to the rotation of the rotating means as the object is swung.

* * * * *